US005784971A

United States Patent [19]

Chang

[11] Patent Number: 5,784,971

[45] Date of Patent: Jul. 28, 1998

[54] PALLET STRUCTURE IMPROVEMENT

[75] Inventor: Wen-Tsung Chang, Taipei Hsien, Taiwan

[73] Assignee: Cheng Loong Corporation

[21] Appl. No.: 861,394

[22] Filed: May 21, 1997

[51] Int. Cl.[6] ..... B65D 19/00

[52] U.S. Cl. ..... 108/51.3; 108/57.19; 108/56.1

[58] Field of Search ..... 108/51.3, 57.19, 108/56.1, 51.11, 56.3

[56] References Cited

U.S. PATENT DOCUMENTS

| | | | |
|---|---|---|---|
| 2,908,464 | 10/1959 | Traudt et al. | 108/51.3 |
| 2,925,947 | 2/1960 | Brown | 108/51.3 |
| 3,131,656 | 5/1964 | Houle | 108/51.3 |
| 4,875,419 | 10/1989 | Helton et al. | 108/51.3 X |
| 5,176,090 | 1/1993 | Roberts et al. | 108/51.3 |
| 5,337,679 | 8/1994 | Moorman | 108/51.3 |
| 5,383,409 | 1/1995 | Hayakawa | 108/51.3 |
| 5,461,988 | 10/1995 | Cummings et al. | 108/51.3 |

*Primary Examiner*—Jose V. Chen

*Attorney, Agent, or Firm*—Rosenberg, Klein & Bilker

[57] ABSTRACT

An improved collapsible pallet assembly structure is provided. The collapsible pallet assembly includes at least a pair of lengthwise beam members and at least a pair of crosswise beam members formed of a corrugated paper material. Each lengthwise beam member includes a surface plate portion from which a plurality of folded sidewall portions extend downward and at least one wing piece portion projects in substantially coplanar manner. The surface plate portion has formed therethrough a plurality of upper slot holes which communicate respectively with a plurality of lower slot holes formed through the sidewall portions. Each crosswise beam member includes a top plate portion from which a plurality of folded bracket plate portions extend downward. Each bracket plate portion includes a slotted opening that delineates a pair of bracket plate extending sections. Each crosswise beam member is coupled to the lengthwise beam members in transverse manner with its top plate portion partially overlaying at least one of the lengthwise beam member surface plate portions, and with at least one extending section of each bracket plate portion inserted through an upper slot hole of a lengthwise beam member surface plate portion.

1 Claim, 24 Drawing Sheets

PALLET STRUCTURE IMPROVEMENT

DESCRIPTION OF INVENTION

The present invention relates to a type of pallet structure improvement particularly to one made of corrugated paper which causes no environmental problems, minimizes transportation expenses, occupies little space before it is configured, and will effectively save production, storage and transportation costs.

For the purpose of transporting products, the use of pallets to carry goods is a simple, economical and efficient method. Goods can be stacked onto stacks which will then be handled by fork lifts. In so doing, a lot more goods can be carried in each transporting trip to save human labor and to easily load goods to appropriate places.

Conventional pallets have been made of wood. However, forest resources have been declining in recent years. It is true that higher pressure-resistant strength is the advantage of pallets made of wood, plastic and metal. In terms of environmental protection, however, the three conventional types of pallet material no longer meet the requirements of environmental preservation. Furthermore, the heavier pallet materials of wood, plastic and metal pallets will not satisfy economic efficiency when weight is based for the calculation of transportation costs. After they are made, the finished products of wooden, plastic and metal pallets will occupy larger spaces and result in much higher storage and transportation costs.

It is understandable that, from the above points of view, in practical applications, conventional pallets do involve inconveniences and disadvantages which need to be improved.

In view of the above disadvantages, the subject inventor has been devoted in the research, with the employment of academic principles, of a reasonable design of the subject invention to effectively improve the aforesaid disadvantages.

The main purpose of the subject invention is to provide a type of pallet structure improvement which is made of recyclable corrugated paper to reduce the production cost of pallets, to recycle damaged pallets for the reproduction of other paper ware, so that natural resources can be recycled, waste disposal expenses can be reduced, waste of resources can be minimized and environmental problems can be avoided.

Another purpose of the subject invention is to provide a type of pallet structure improvement, using light-weight corrugated paper to minimize the transportation expenses of pallets, to reduce the burden of operators and to ensure better operational safety.

Another further purpose of the subject invention is to provide a type of pallet structural improvement which is flat folded before it is configured for ready use, so that it will save much space, effectively save costs on production, storage and transportation.

To achieve the above purposes and construction, the designing methods and functions of the subject invention are described in the following embodiment figures:

BRIEF DESCRIPTION OF NUMERALS

| | | | |
|---|---|---|---|
| 10 | pallet | 11 | lengthwise beam |
| 12 | crosswise beam | 13 | surface plate |
| 14 | folding line | 15 | side wall |
| 16 | penetrating hole | 17 | wing piece |
| 18 | groove | 19 | groove |
| 20 | punctured hole | 21 | top plate |
| 22 | bracket plate | 23 | folding line |
| 24 | opening | 25 | post |
| 26 | wing piece | 27 | indentation |
| 28 | opening | 29 | reinforcing piece |
| 30 | bracket plate | 31 | bracket plate |
| 32 | opening | 33 | opening |
| 34 | bottom plate | 35 | bracket plate |
| 36 | folding line | 37 | groove |
| 38 | opening | | |

Figure 1:
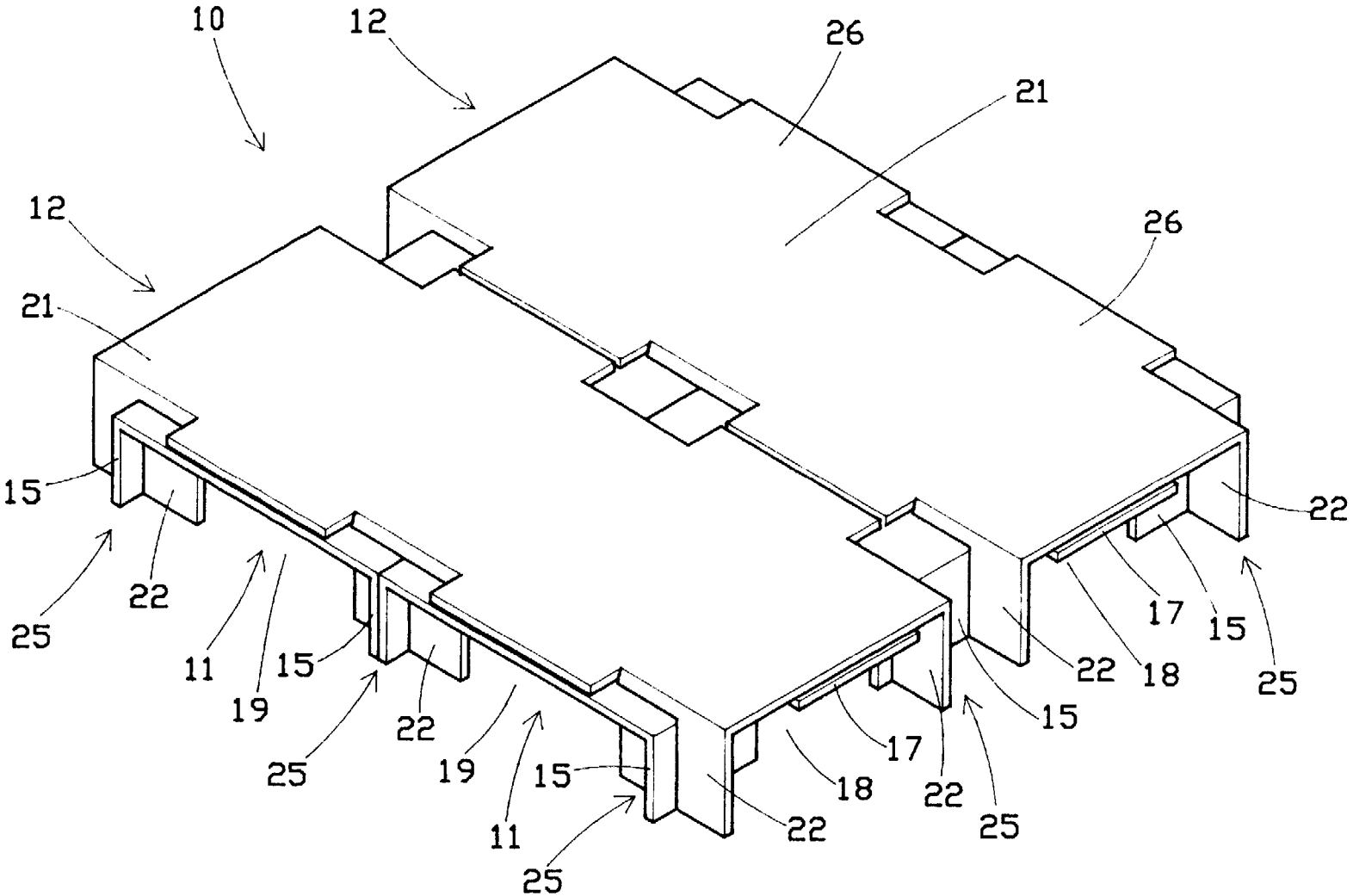
FIG. 1 is the perspective view of the first pallet embodiment.
Figure 3:
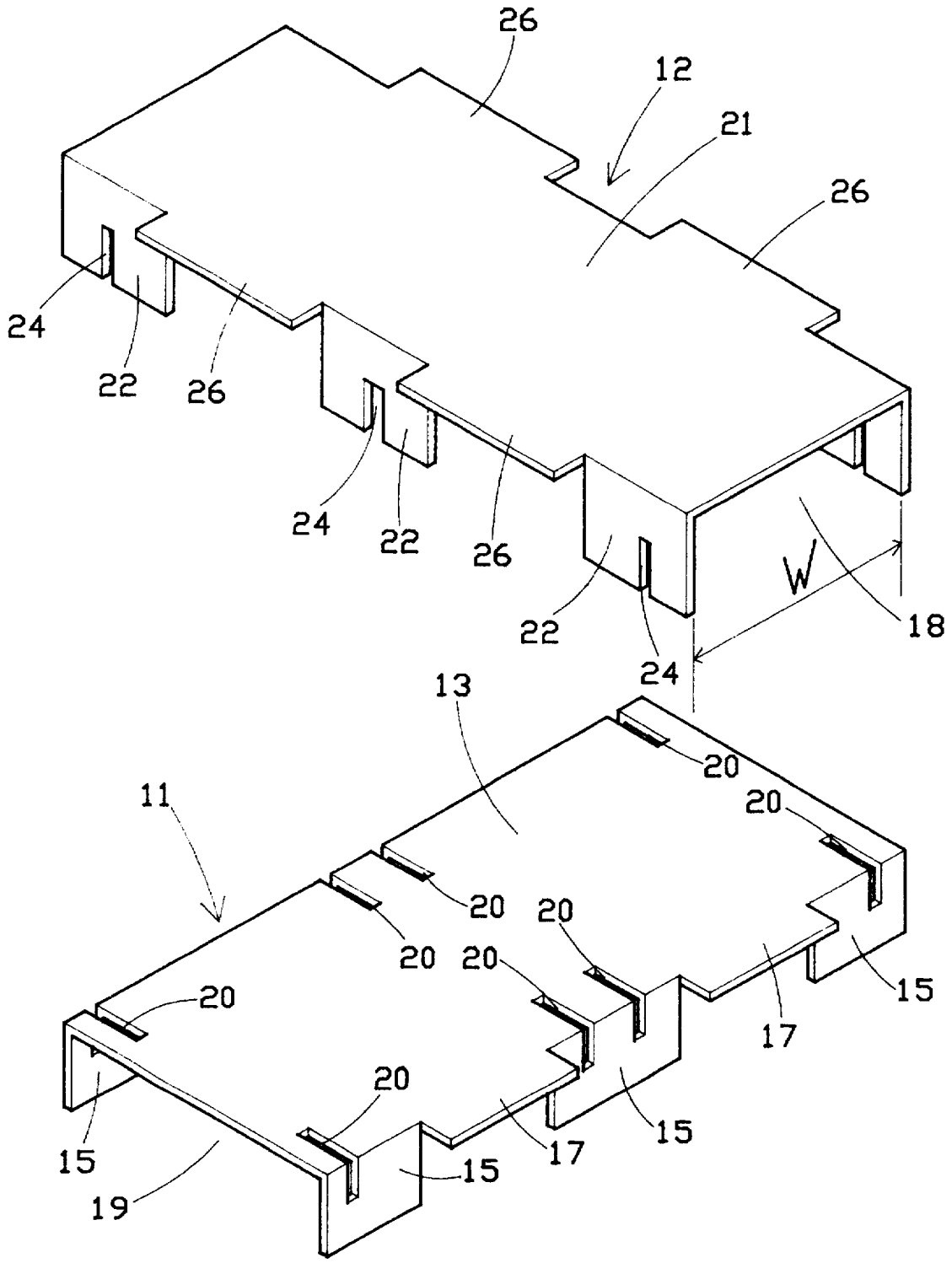
FIG. 3 is the perspective view of the crosswise beam and lengthwise beam of the first pallet embodiment.
Figure 4:
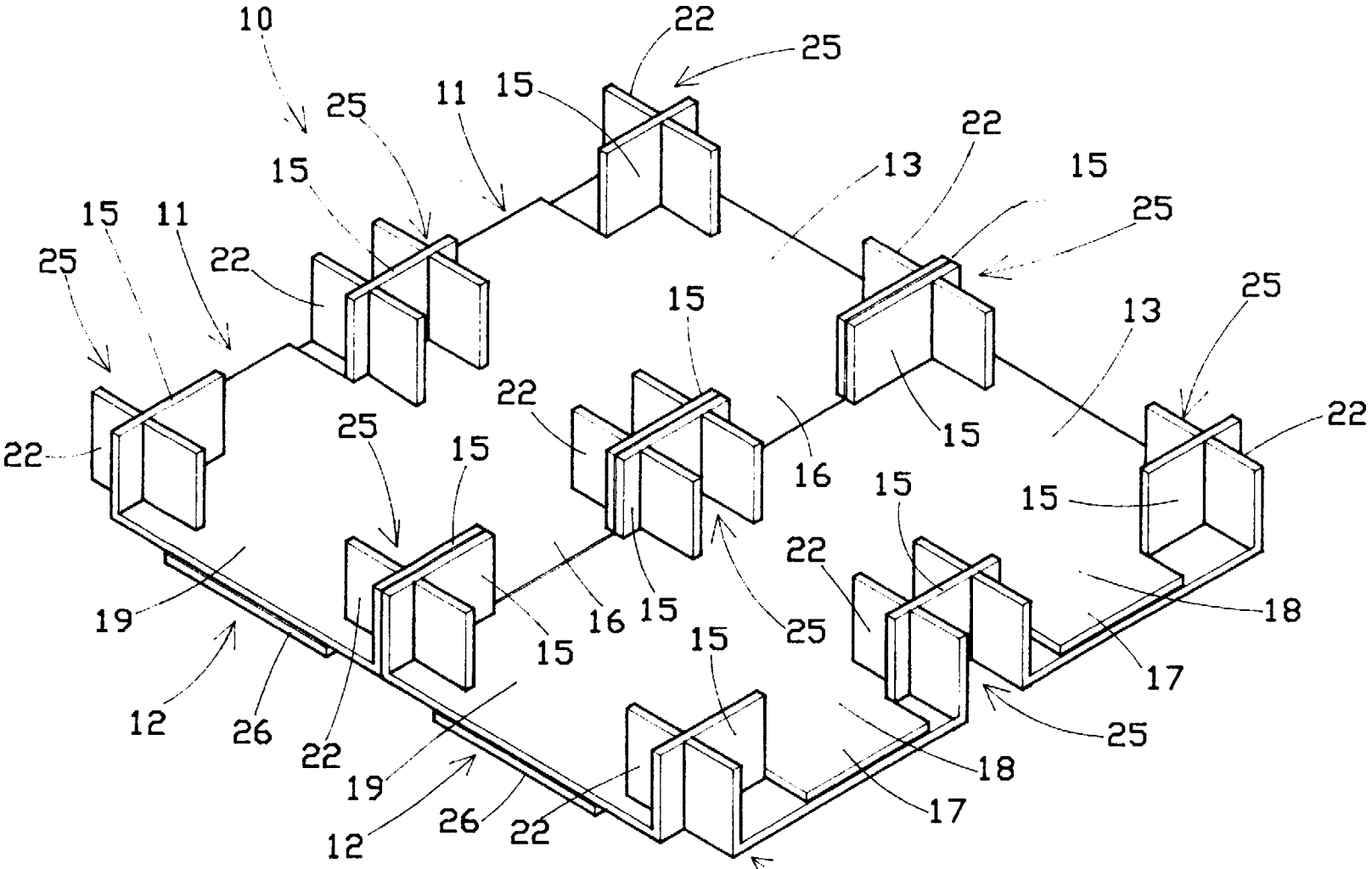
FIG. 4 is the perspective bottom view of the crosswise beam and lengthwise beam of the first pallet embodiment.

As illustrated in FIGS. 1 and 4, the subject invention relates to a type of pallet structural improvement. The preferred embodiment of the subject pallet 10 (the first embodiment) is composed of two lengthwise beams 11 and two crosswise beams, said lengthwise beam 11 and crosswise beam 12 are respectively corrugated paper cut to the flat shape illustrated in FIG. 2, before they are folded into three-dimensional configuration as in FIG. 3, then, the lengthwise beam 11 and crosswise beam 12 are vertically dovetailed to become an integrated, complete pallet 10.

Figure 2:
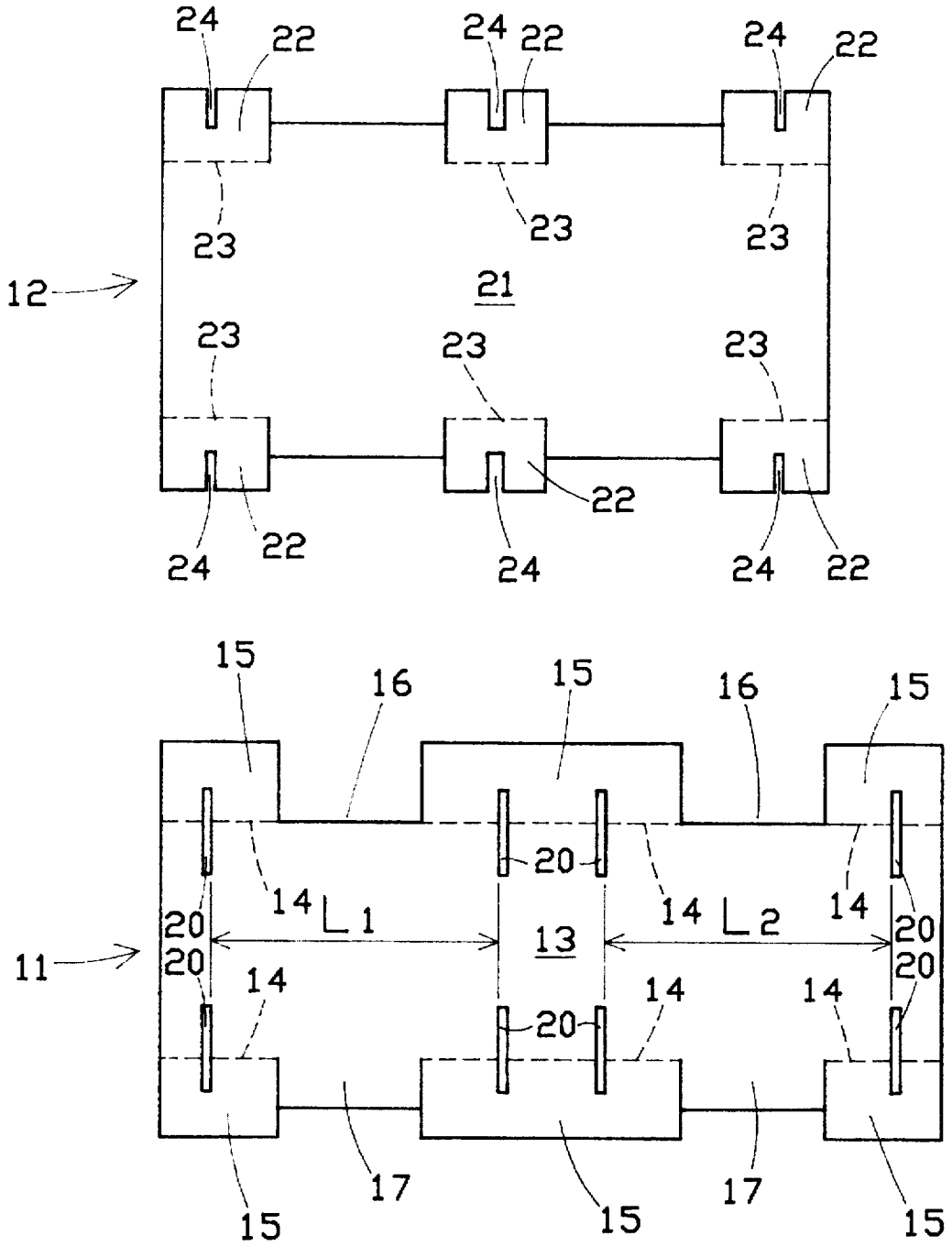
FIG. 2 is the spread view of the crosswise beam and lengthwise beam of the first pallet embodiment.

As illustrated in FIG. 2, said lengthwise beam 11 includes an elongated rectangular surface plate 13 with its two lengthwise sides connected by the side wall 15 on the folding line 14, one longer side of the surface plate 13 connecting to the side wall 15 with two penetrating holes 16 between them, another long side of surface plate 13 connecting to the side wall 15 with two wing pieces 17 between them. Side wall 15 can be folded along the folding line 14 to be vertical to surface plate 13, to comprise a U-shaped cross section, and meanwhile, it defines a groove 19, and the two wing pieces 17 protrude from the two longer sides of surface plate 13, after the crosswise beam 12 is joined to the lengthwise beam 11, said wing piece 17 can overlapped below the top plate 21 of the crosswise beam 12, to increase the pressure resistance of the pallet 10. The shape of the groove 19 is shown in FIG. 3, by means of the side wall 15, the surface plate 13 can be properly lifted to allow the insertion of the lifting arm of the fork lift into the groove 19 to raise the pallet. On the two longer sides of surface plate 13 are four holes 20, with two holes on two ends and two holes at the middle, the distance between the two holes 20 on the left is equal to that two on the right, the holes 20 are extending to the surface plate 13 and the side wall 15.

As illustrated in FIG. 2, said crosswise beam 12 comprises of an elongated rectangular top plate 21, with its two longer sides including three bracket plate 22 connecting to the top plate 21, said bracket plate connects to the top plate 21 at the folding line 23, said bracket plate 22 can be folded along the folding line 23 to be vertical to the top plate 21, to comprise a U-shaped cross section, meanwhile it defines a groove 18 which shape is shown in FIG. 3. The width W of said U-shaped crosswise beam 12 is equivalent to the hole distance L1 of the lengthwise beam 11, so the bracket plate 22 can be precisely inserted to the corresponding hole 20. The bracket plate 22 further includes an opening 24, said opening 24 extends downwards from the middle of bracket plate 22 to the bottom, so the bracket plate 22 can be inserted to the hole 20 of the crosswise beam 11, so that the lengthwise beam 11 and crosswise beam 12 are vertically combined and integrated as one unit, forming the paper-made pallet 10, after the bracket plate 22 is inserted into the hole 20, bracket plate 22 intersects with side wall 15 to form a cross figure, to comprise the post 25 of the pallet 10, said posts 25 are evenly distributed at the four corners, middle and peripheral positions of pallet 10, so that the pallet 10 will have sufficient pressure resistance to withhold the load. When bracket plate 22 is folded to be vertical to top plate 21, the neighboring two bracket plates 22 brace a wing piece 26 protruding from the two sides of the top plate 21, after the crosswise beam 12 is joined with the lengthwise beam 11, said wing piece 26 can be overlapped onto the surface plate of the lengthwise beam 11, to increase the pressure resistance of the pallet 10.

Figure 6:
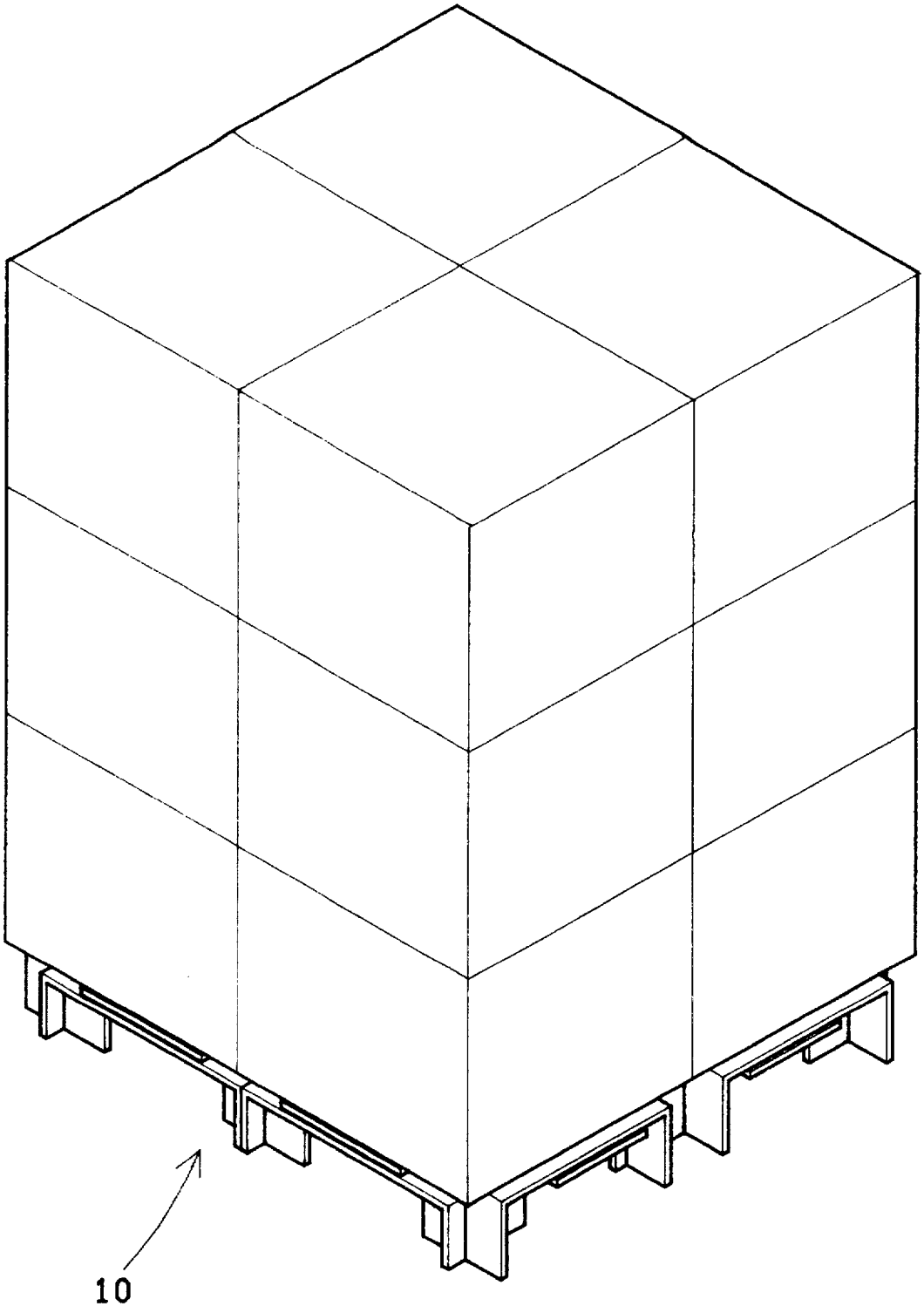
FIG. 6 is the view of the first pallet embodiment in actual operation.

The subject pallet 10, structured according to the above, is a cross opening type, the lifting arm of a fork lift can be inserted into the groove 18 or 19 on four corners of the pallet 10, but its structure includes several posts 25 to comprise a supporting frame, though its resistance to pressure is weaker than that of wooden, plastic and metal pallets, but it is more than sufficient to carry such light-weight items as tissue paper, facial paper, computer, etc. (shown in FIG. 6), so its practical feature is beyond doubt.

Figure 5:
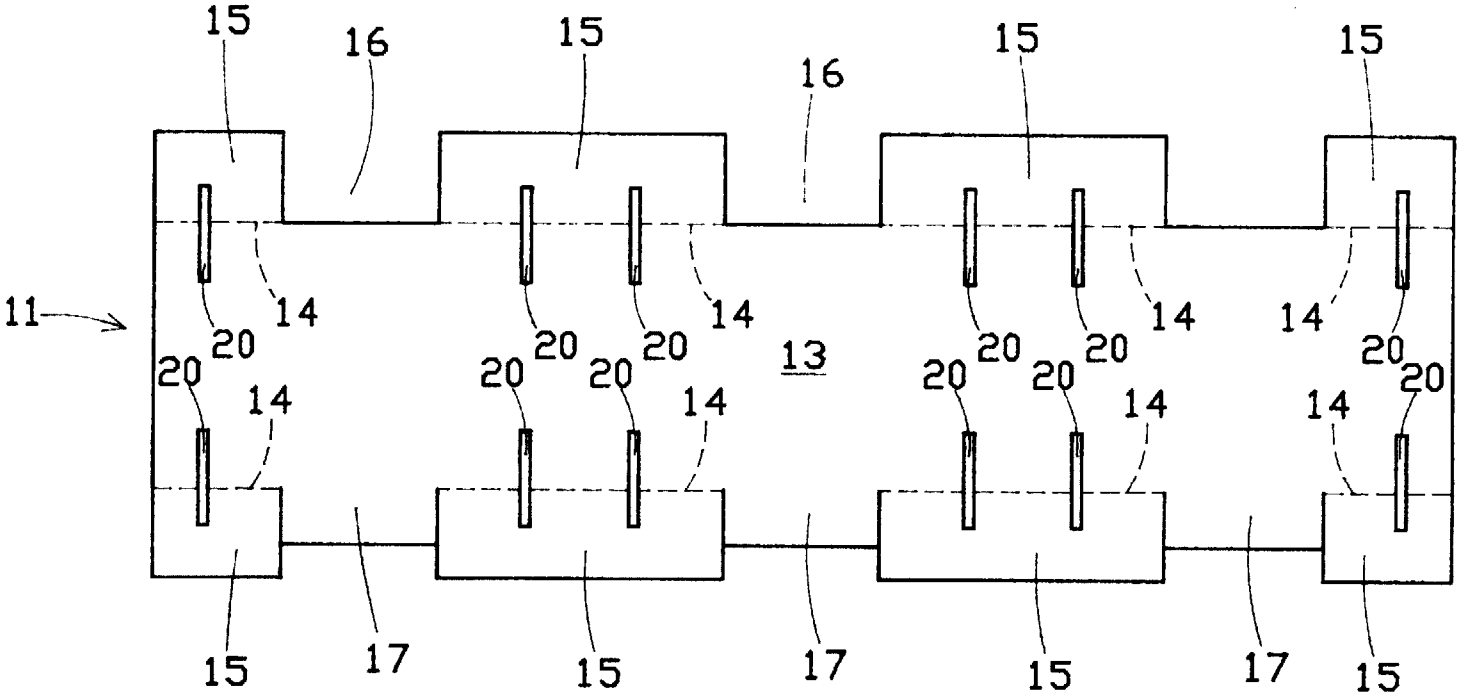
FIG. 5 is the spread view of the lengthwise beam of the second pallet embodiment.

The subject pallet has its extensive applications. The above embodiment illustrations are composed of two lengthwise beams 11 and two crosswise beams 12 to comprise pallets of 2×2 specifications. But after extension as illustrated in FIG. 5, the second embodiment of the subject invention is composed of two lengthwise beams 11 and three crosswise beams 12 to comprise pallets of 2×3 specifications. In this case, the length of lengthwise beam 11 shall be longer than the length of lengthwise beam 11 of 2×2 specifications, and four additional holes 20 shall be drilled, that is, there shall be 12 holes 20 on each lengthwise beam 11, to enable the insertion of bracket plates 22 of three crosswise beams 12, and the structure of crosswise beam 12 needs no change.

Figure 7:
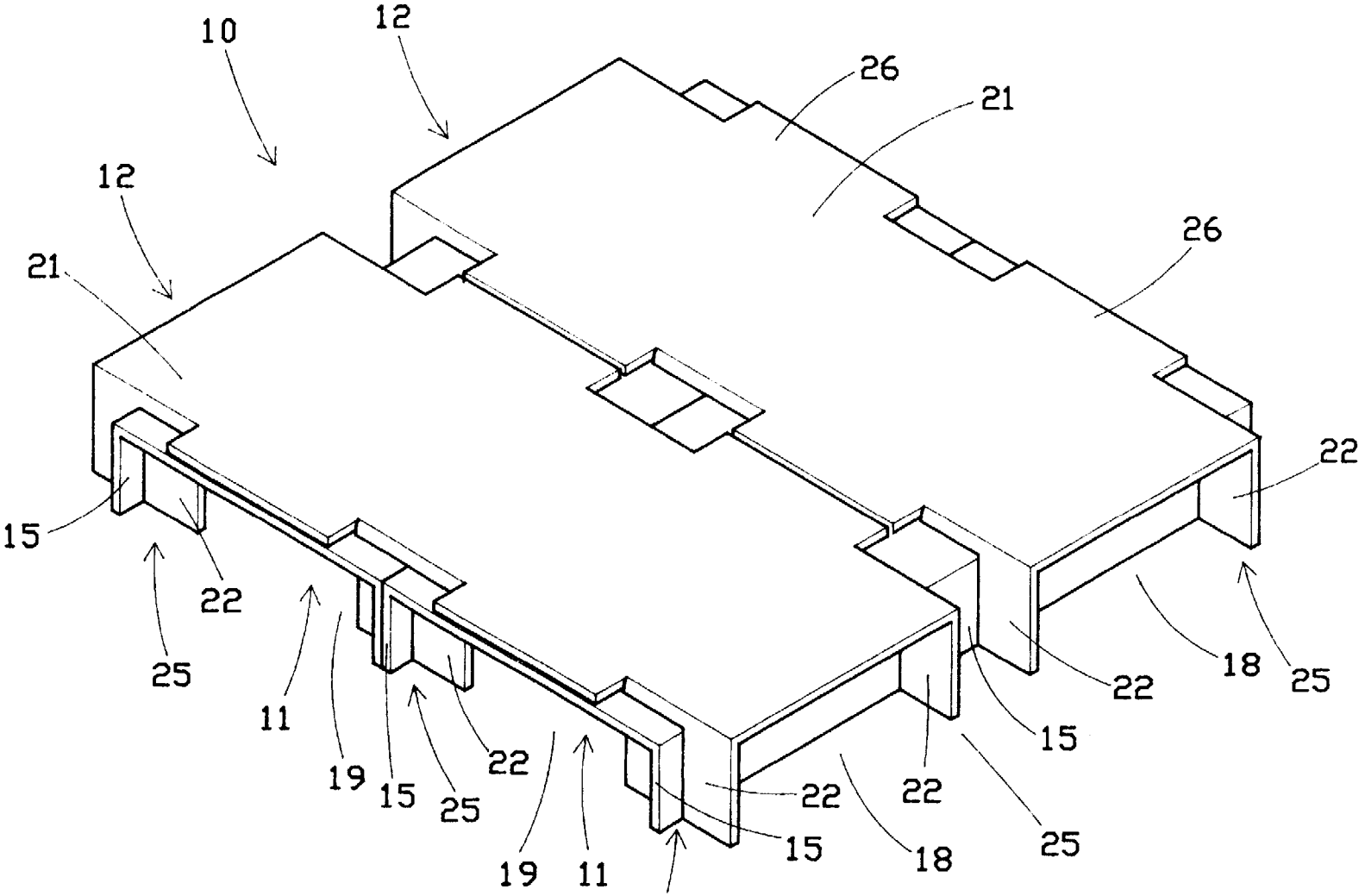
FIG. 7 is the perspective view of the third pallet embodiment.
Figure 8:
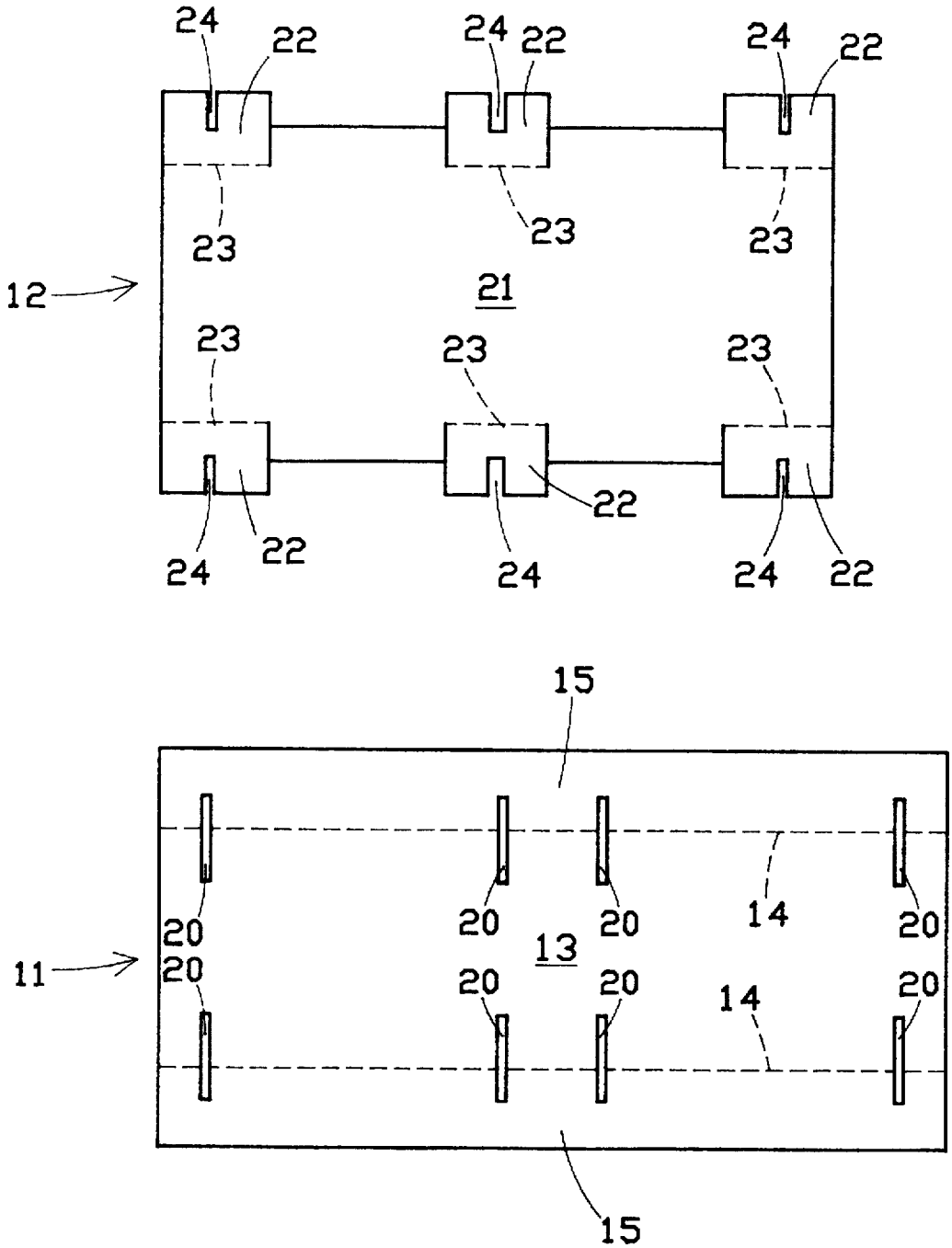
FIG. 8 is the spread view of the crosswise beam and lengthwise beam of the third pallet embodiment.
Figure 9:
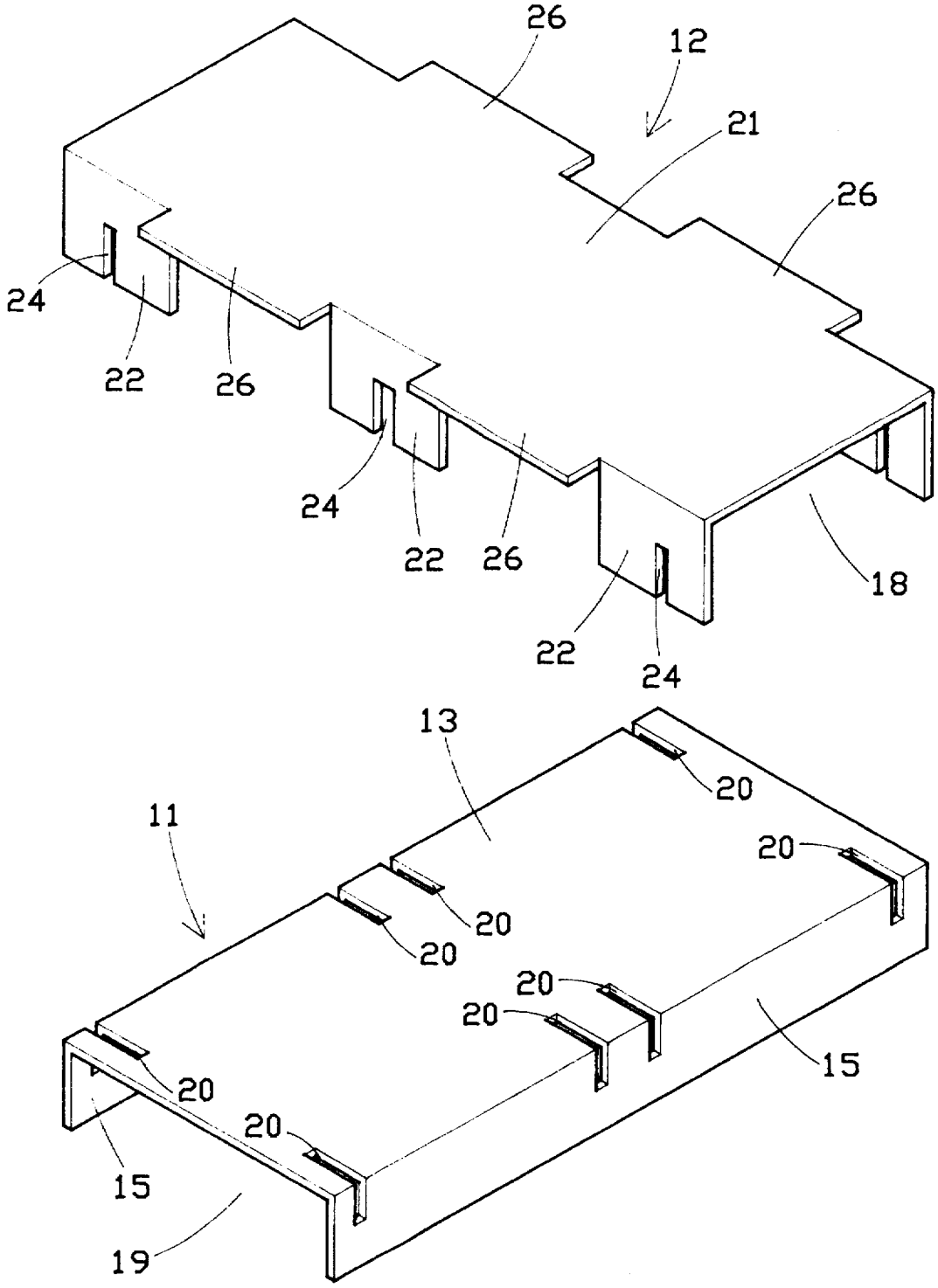
FIG. 9 is the perspective view of the crosswise beam and lengthwise beam of the third pallet embodiment.

As in FIGS. 7, 8 and 9, the third embodiment of the subject invention, the side wall 15 on the two longer sides of said lengthwise beam 11 can be designed to be continuous, the pallet 10 of such structure is of two-way open type, the two side walls of the pallet 10 are enclosed, the lifting arm of a fork lift can only be inserted in the groove 19 on two sides of pallet 10, to lift the pallet.

Figure 10:
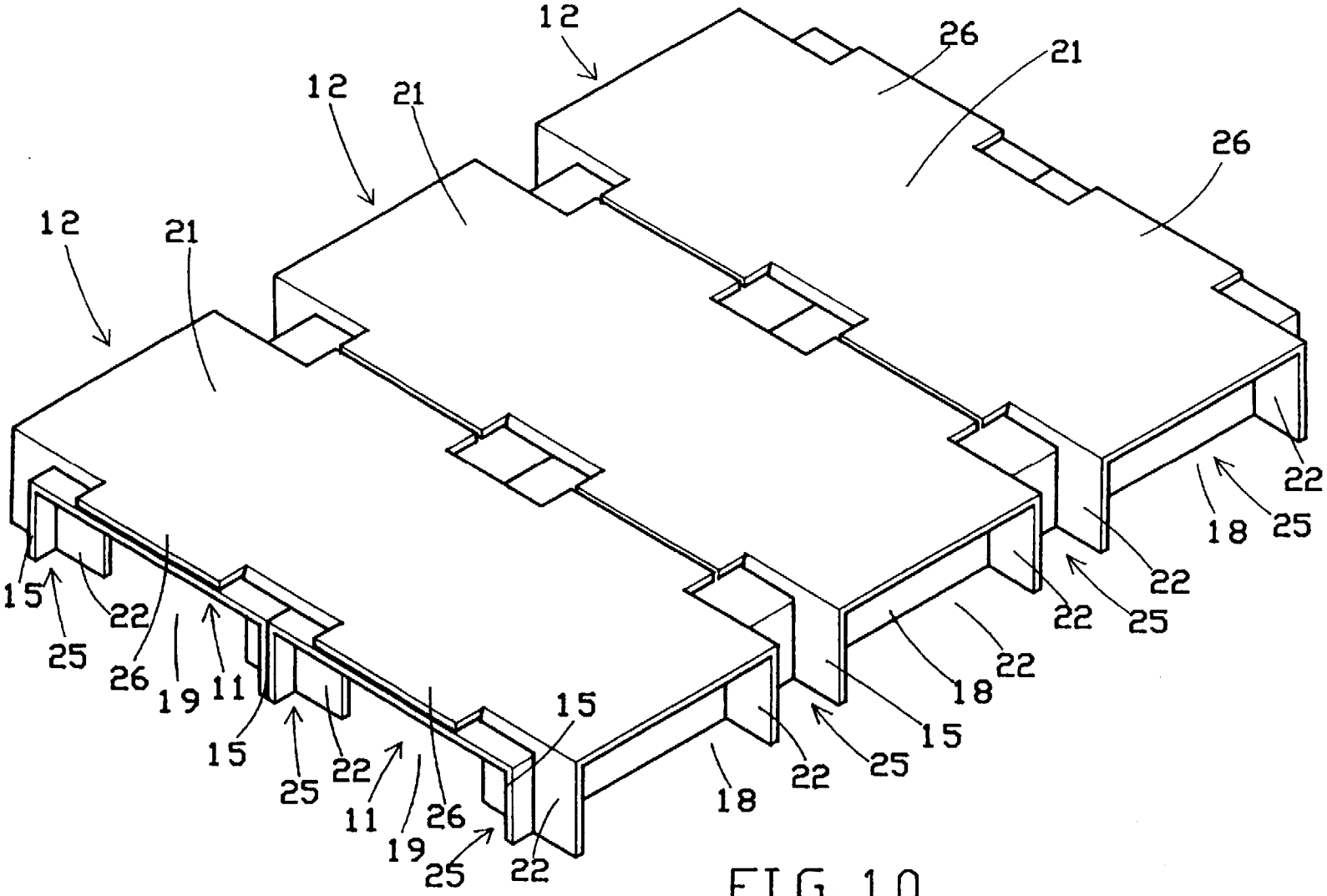
FIG. 10 is the perspective view of the fourth pallet embodiment.
Figure 11:
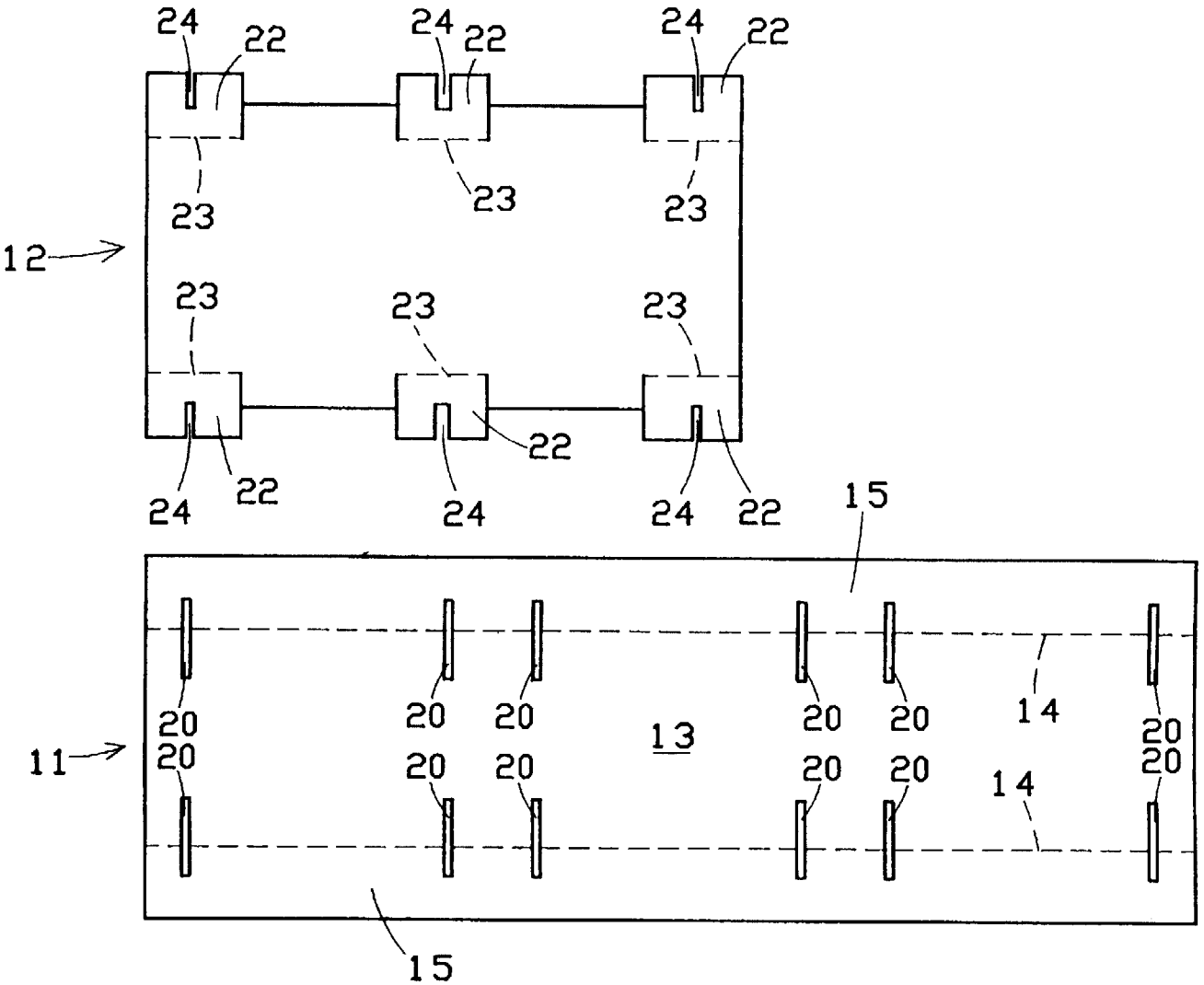
FIG. 11 is the spread view of the crosswise and lengthwise beams of the fourth pallet embodiment.
Figure 12:
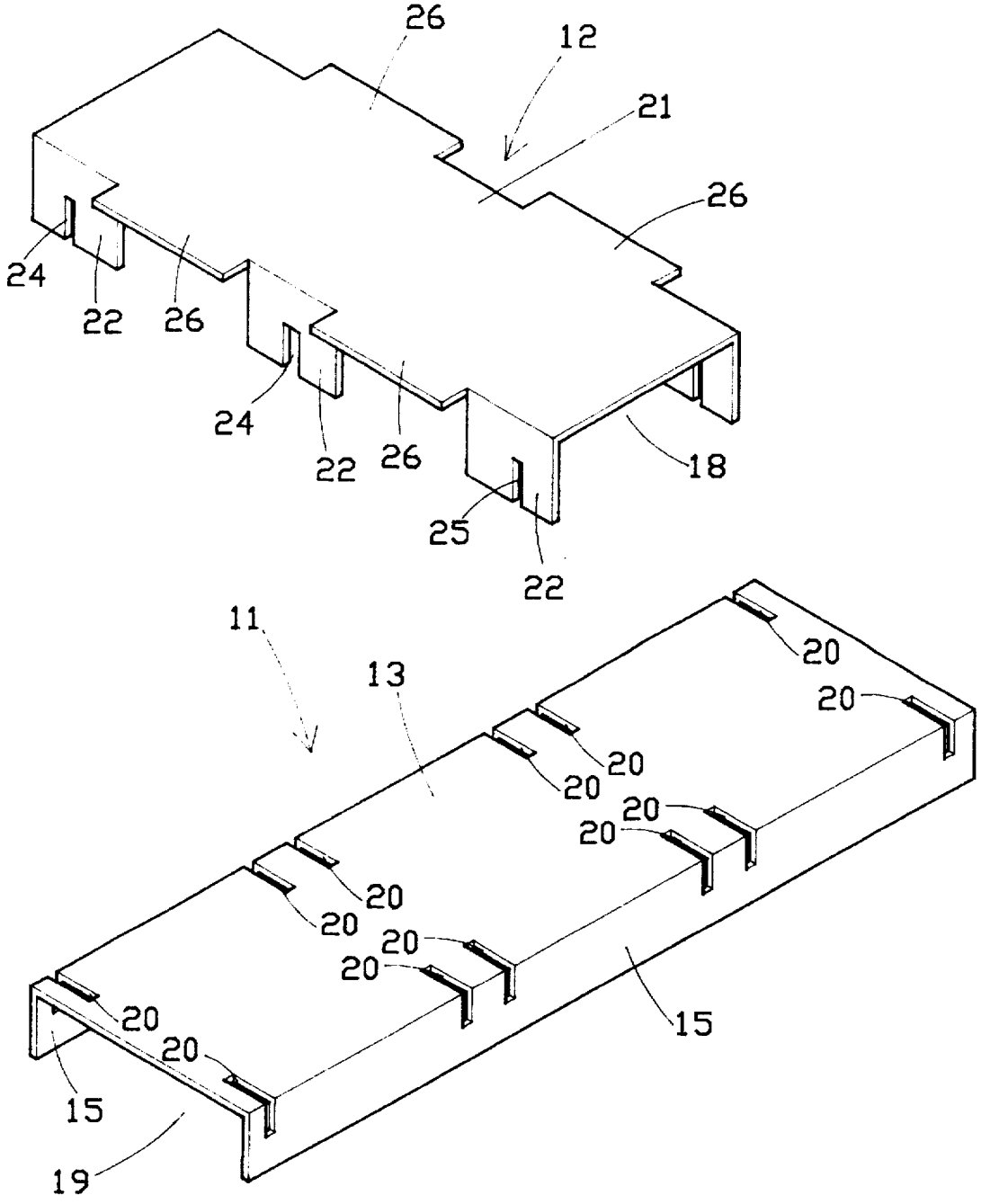
FIG. 12 is the perspective view of the crosswise and lengthwise beams of the fourth pallet embodiment.

As in FIGS. 10, 11 and 12, the fourth embodiment of the subject invention, aforesaid third embodiment can also be composed of two lengthwise beams 11 and three crosswise beam 12, i.e. pallet of 2×3 specifications, on the lengthwise beam 11 is a total of 12 holes 20 for the insertion of bracket plates 22 of the three crosswise beams 12, the structure of crosswise beam 12 needs no change.

Figure 13:
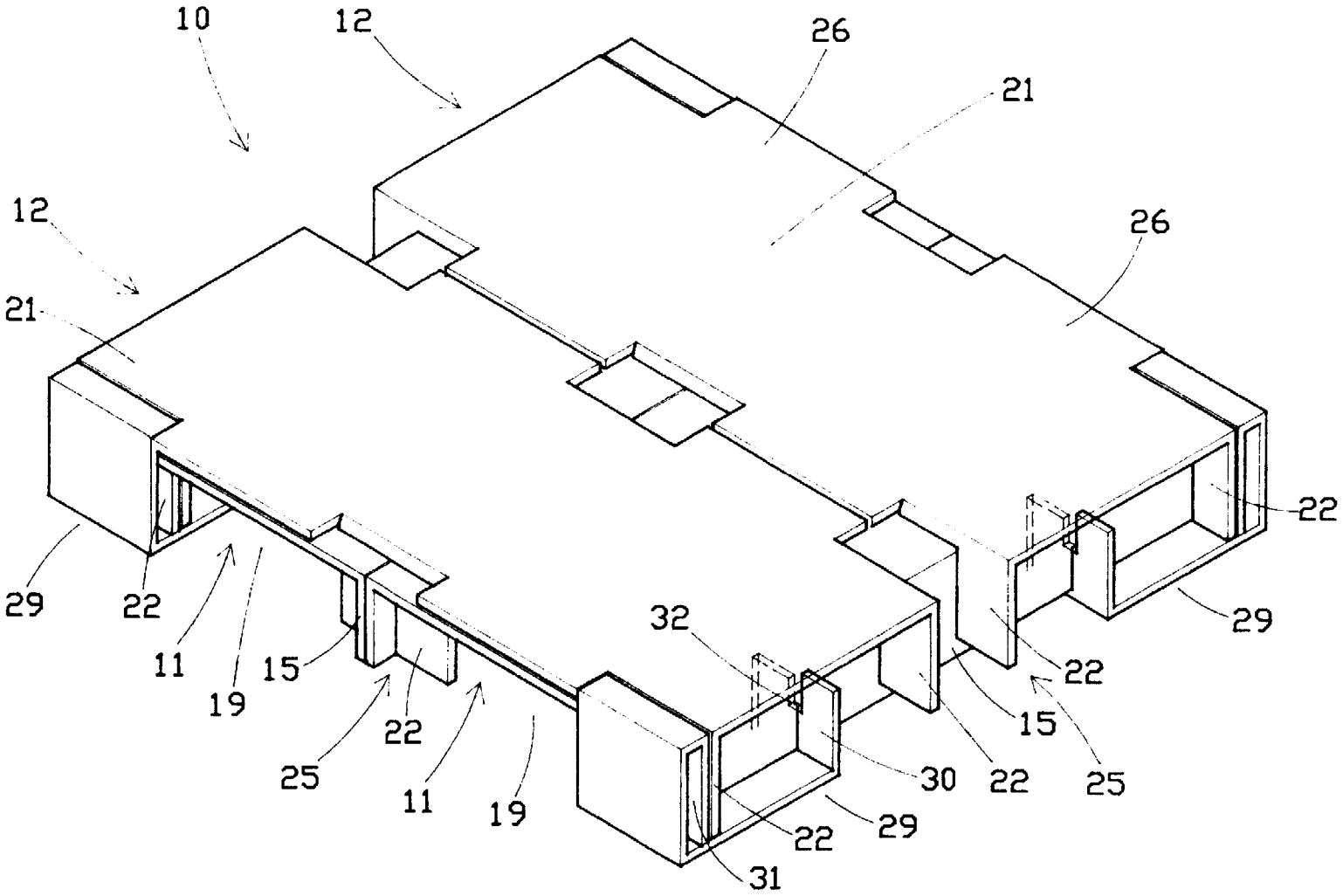
FIG. 13 is the perspective view of the fifth pallet embodiment.
Figure 14:
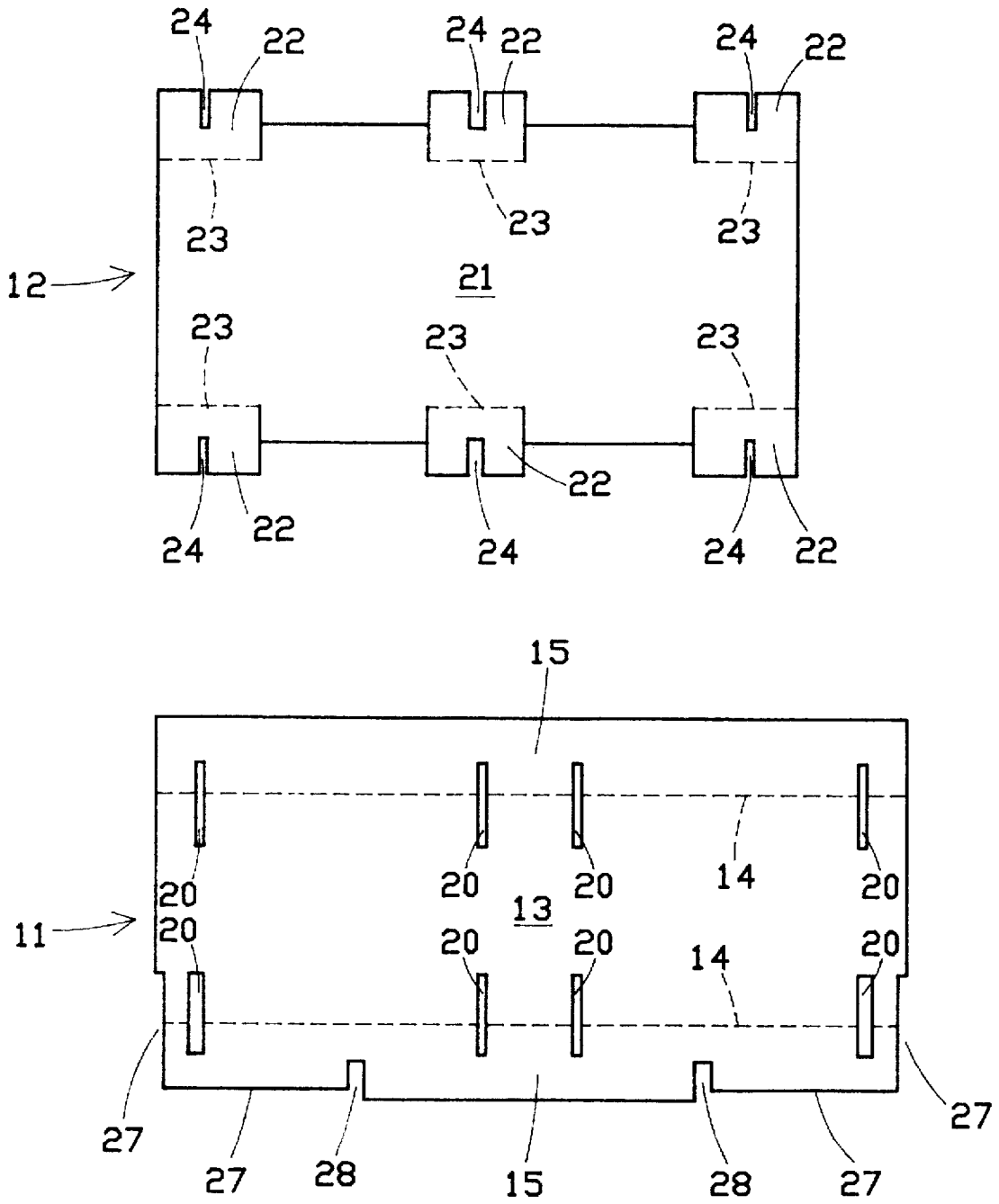
FIG. 14 is the spread view of the crosswise and lengthwise beams of the fifth pallet embodiment.
Figure 15:
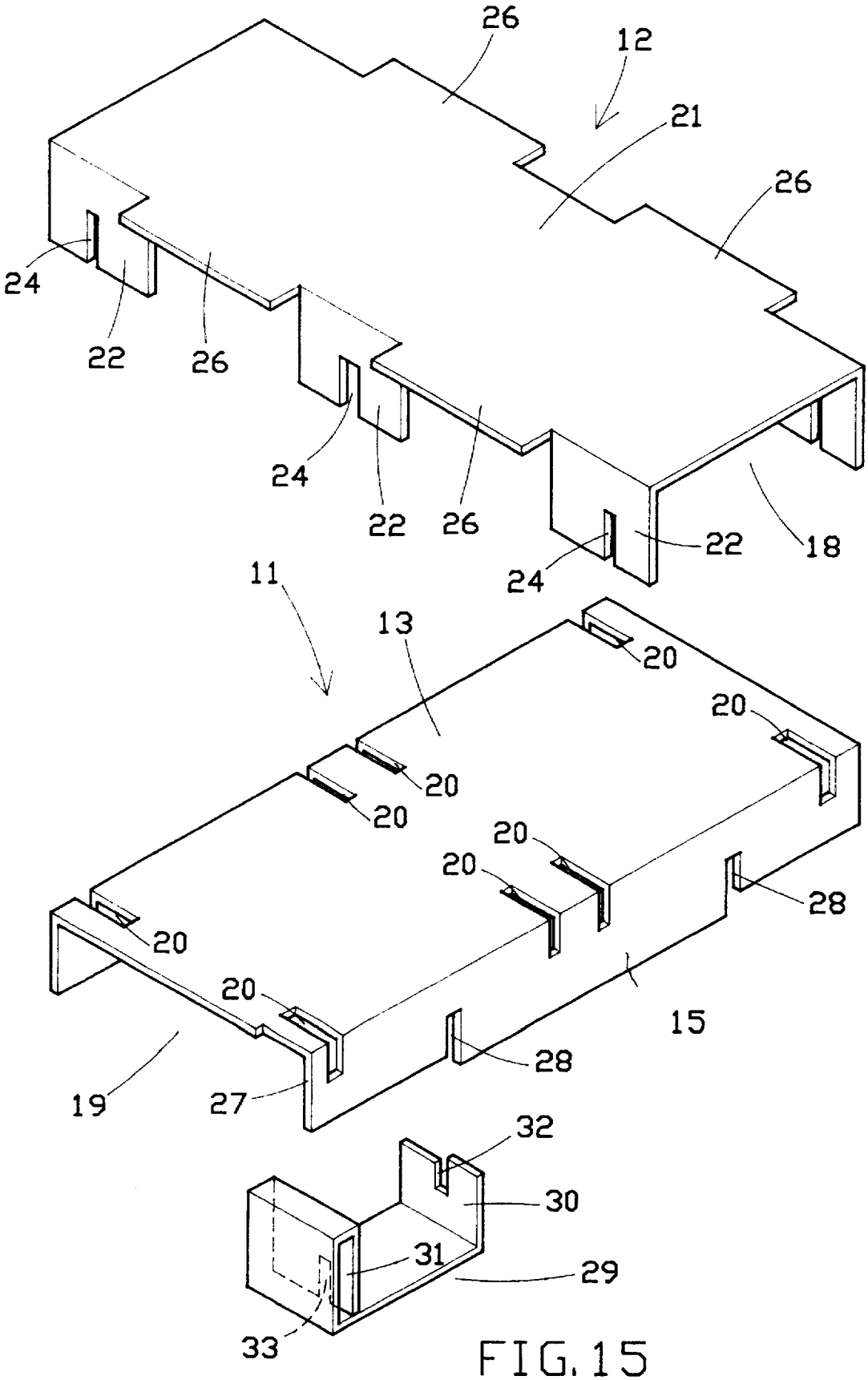
FIG. 15 is the perspective view of the crosswise and lengthwise beams and reinforcement of the fifth pallet embodiment.

As in FIGS. 13, 14 and 15, the fifth embodiment of the subject invention, the width of hole 20 on two ends of one longer side of lengthwise beam 11 can be properly enlarged, and on two ends of one longer side of lengthwise beam 11 are the indentation 27, and the opening 28, with four reinforcement parts 29 which are composed of folded corrugated board, on two ends of the reinforcement part 29 are a bracket plate 30 and 31, on the bracket plates 30 and 31 are respectively an opening 32 and 33, so that bracket plates 31 and 32 can be inserted into the opening 28 and hole 20 of the lengthwise beam 11, so that the reinforcement part 29 is joined to the four corners of the base of pallet 10, to increase the strength of the pallet 10.

Figure 16:
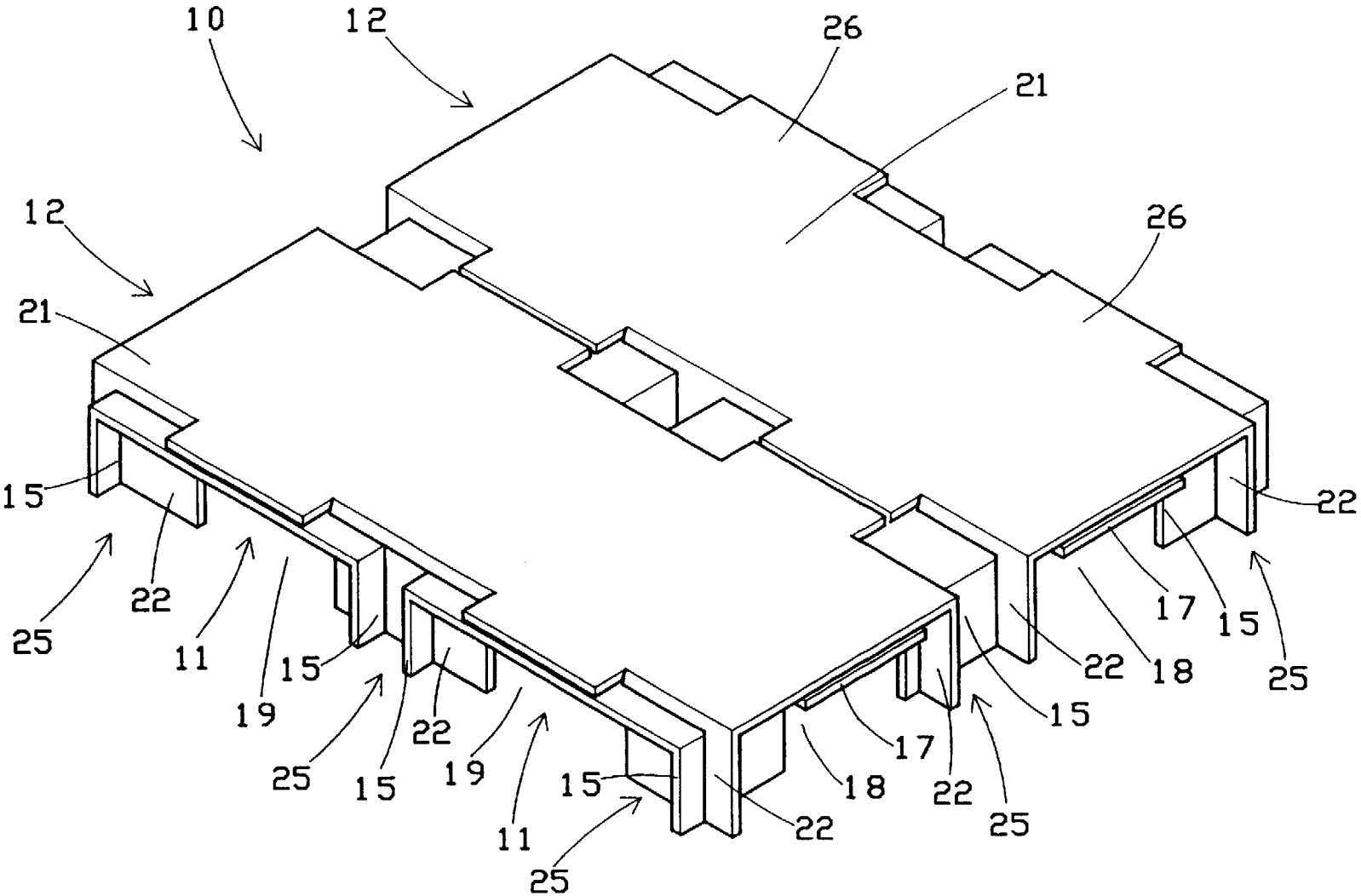
FIG. 16 is the perspective view of the sixth pallet embodiment.
Figure 17:
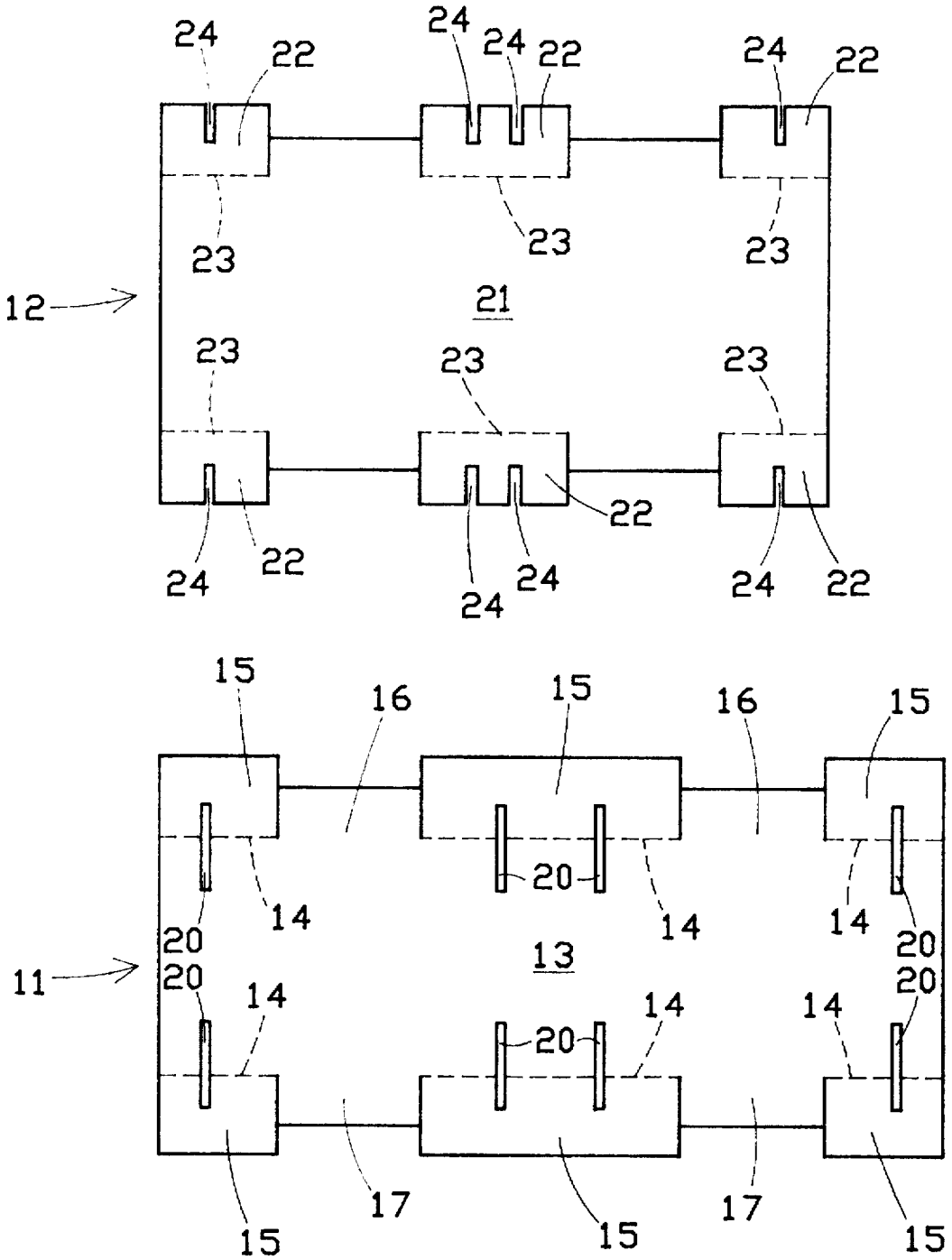
FIG. 17 is the spread view of the crosswise and lengthwise beams of the sixth pallet embodiment.
Figure 18:
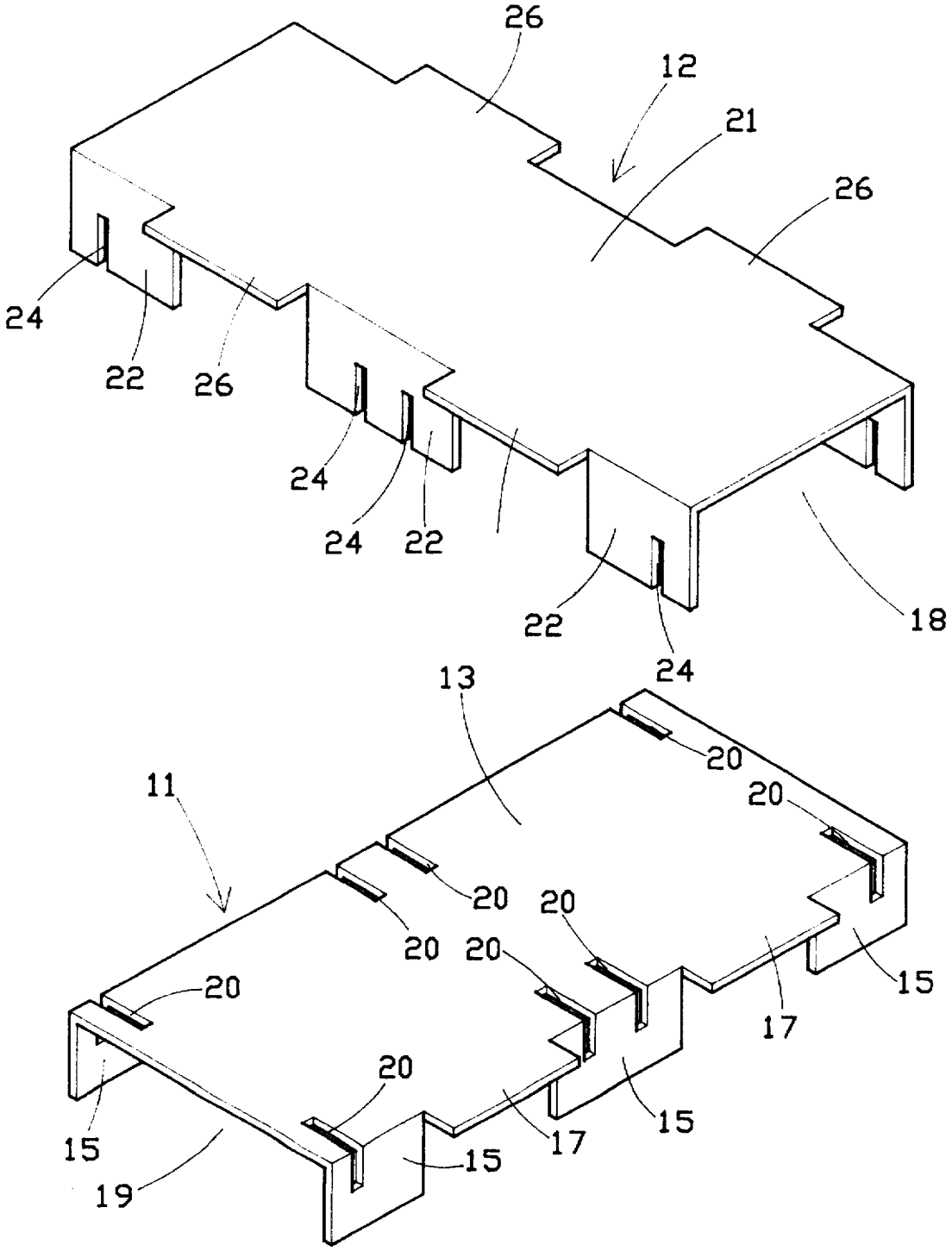
FIG. 18 is the perspective view of the crosswise and lengthwise beams of the sixth pallet embodiment.

As in FIGS. 16, 17 and 18, the sixth embodiment of the subject invention, on the bracket plates 22 in the middle of the two longer sides of crosswise beam 12 can have two openings 24, so that, when the bracket plate 22 is inserted into the hole 20, the bracket plate 22 will be crossed with side wall 15, so that the post in the middle of pallet 10 comprises a "#" figure, to provide different shapes of the post 25.

Figure 19:
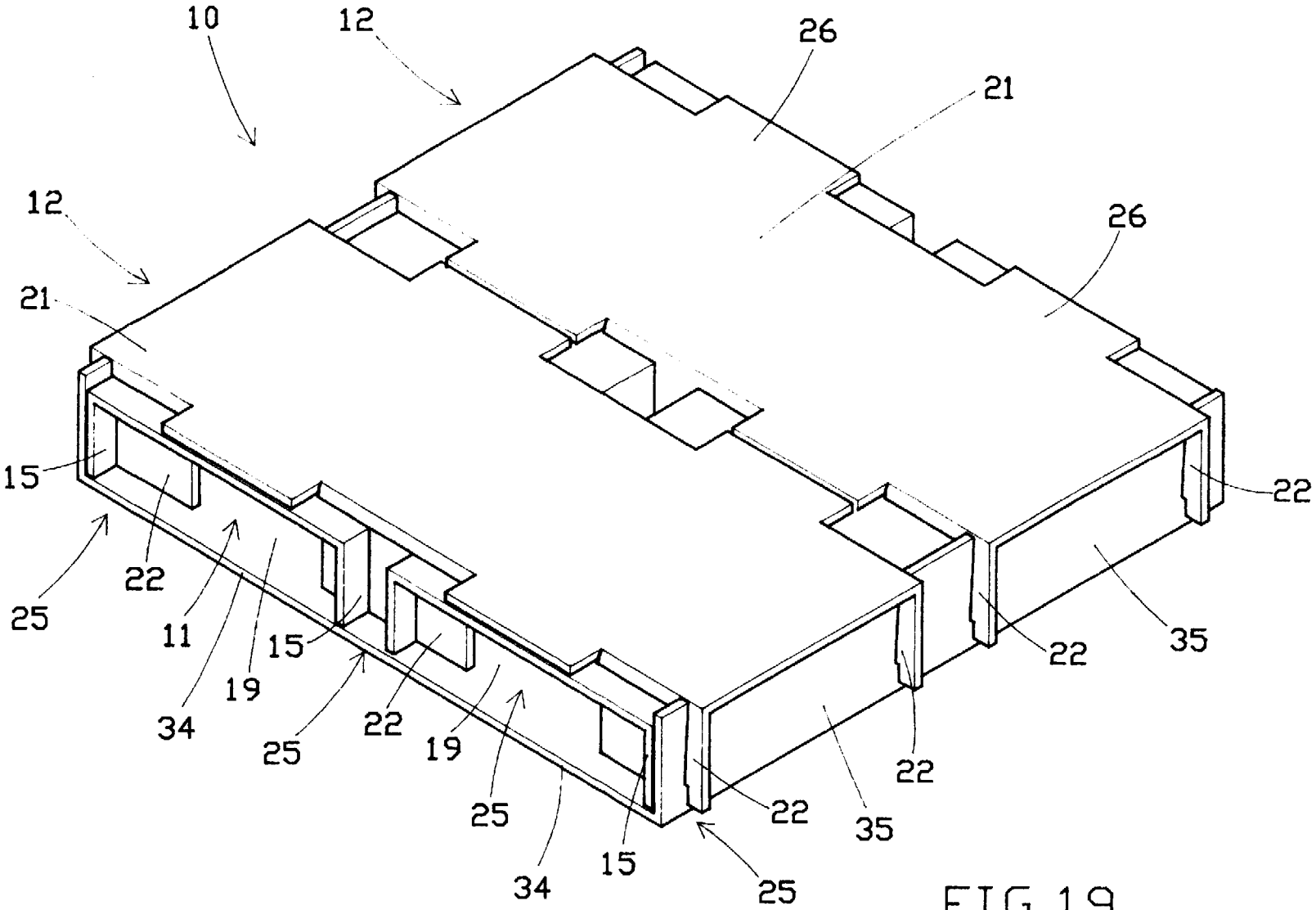
FIG. 19 is the perspective view of the seventh pallet embodiment.
Figure 20:
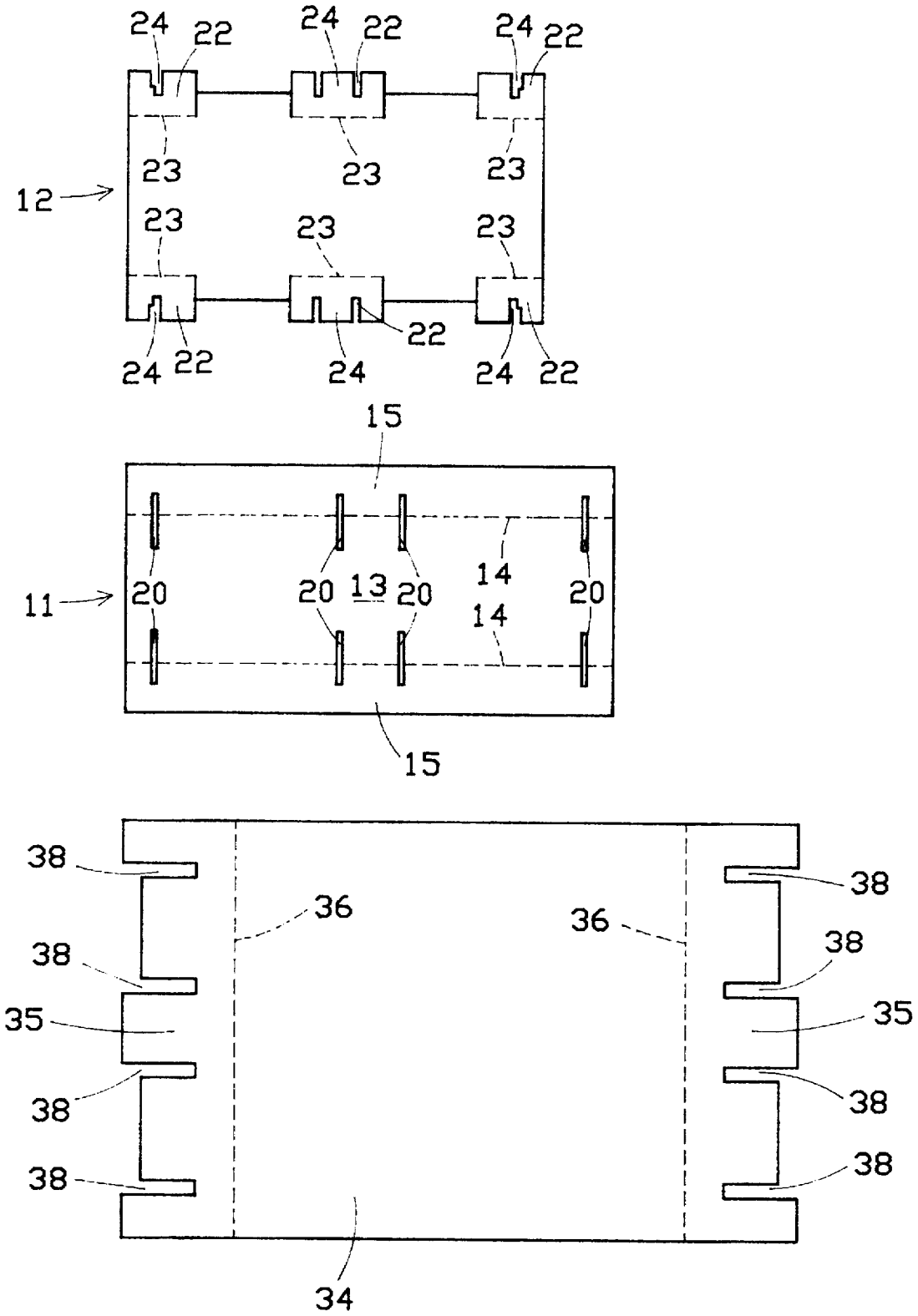
FIG. 20 is the spread view of the crosswise and lengthwise beams, and bottom plate of the seventh pallet embodiment.
Figure 21:
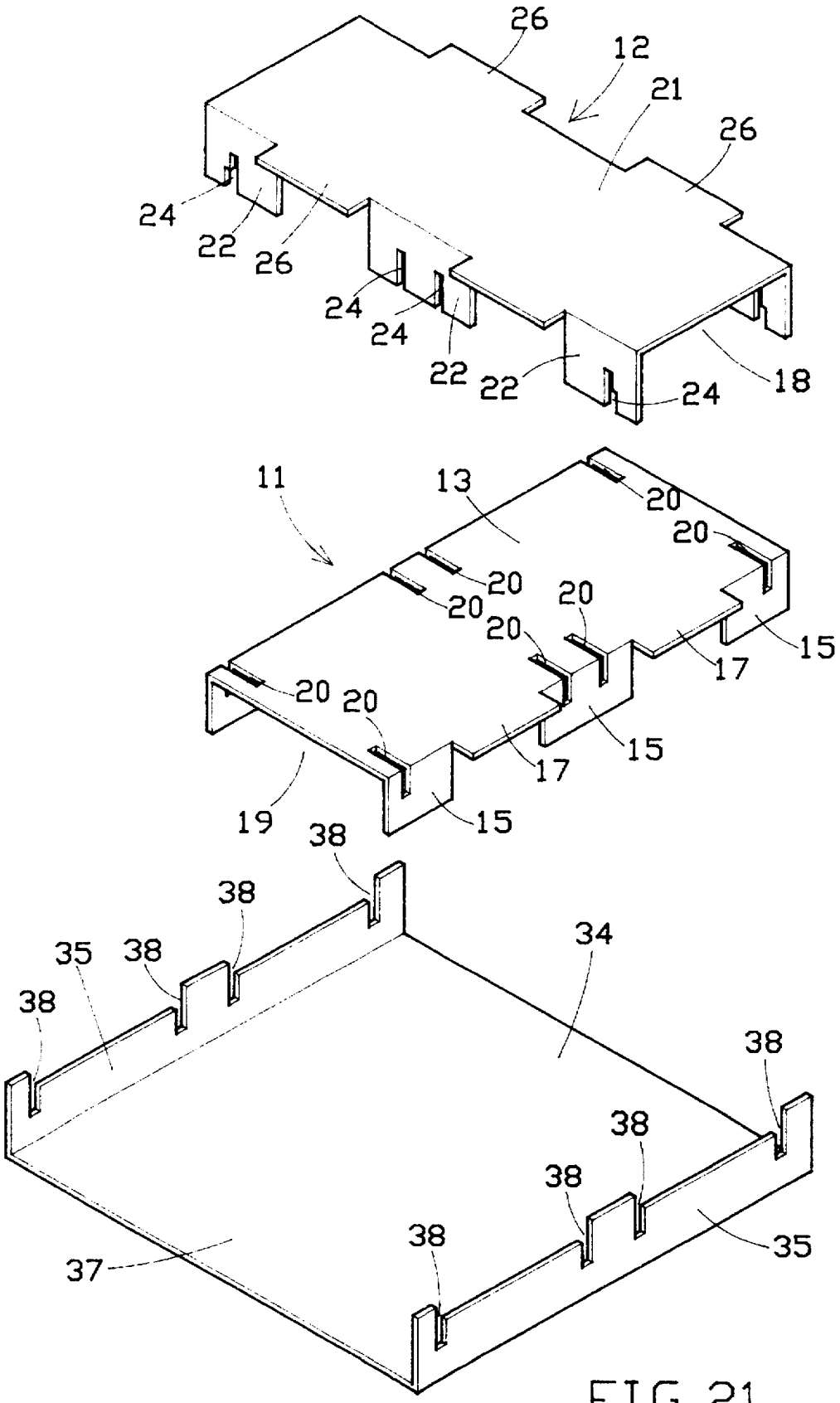
FIG. 21 is the perspective view of the crosswise and lengthwise beams, and bottom plate of the seventh pallet embodiment.

As in FIGS. 19, 20 and 21, the seventh embodiment of the subject invention, on the bottom of pallet 10 can have a bottom plate 34 which is made of corrugated board being cut to shape, two sides of bottom plate 34 are joined by a bracket plate 35 at the folding line 36, the bracket plate 36 can be folded along the folding line 36 to be vertical to the bottom plate 34, to form a U-shaped cross section, and it defines a groove 37, on the bracket plate 35 are several openings 38 which extend upwards to the top from the middle of the bracket 35, furthermore, the opening 24 of bracket plate 22 at two ends of crosswise beam 12 can have appropriate change, said bottom plate 34 is composed by inserting the opening 38 of the bracket plate 35 to the opening 24 of the bracket plate 22 of the crosswise beam 12, to join the bottom plate 34 to the bottom of pallet 10, to increase the strength of pallet 10, and also to form a flat surface on the bottom of the pallet 10, to enable secure positioning of goods.

Figure 22:
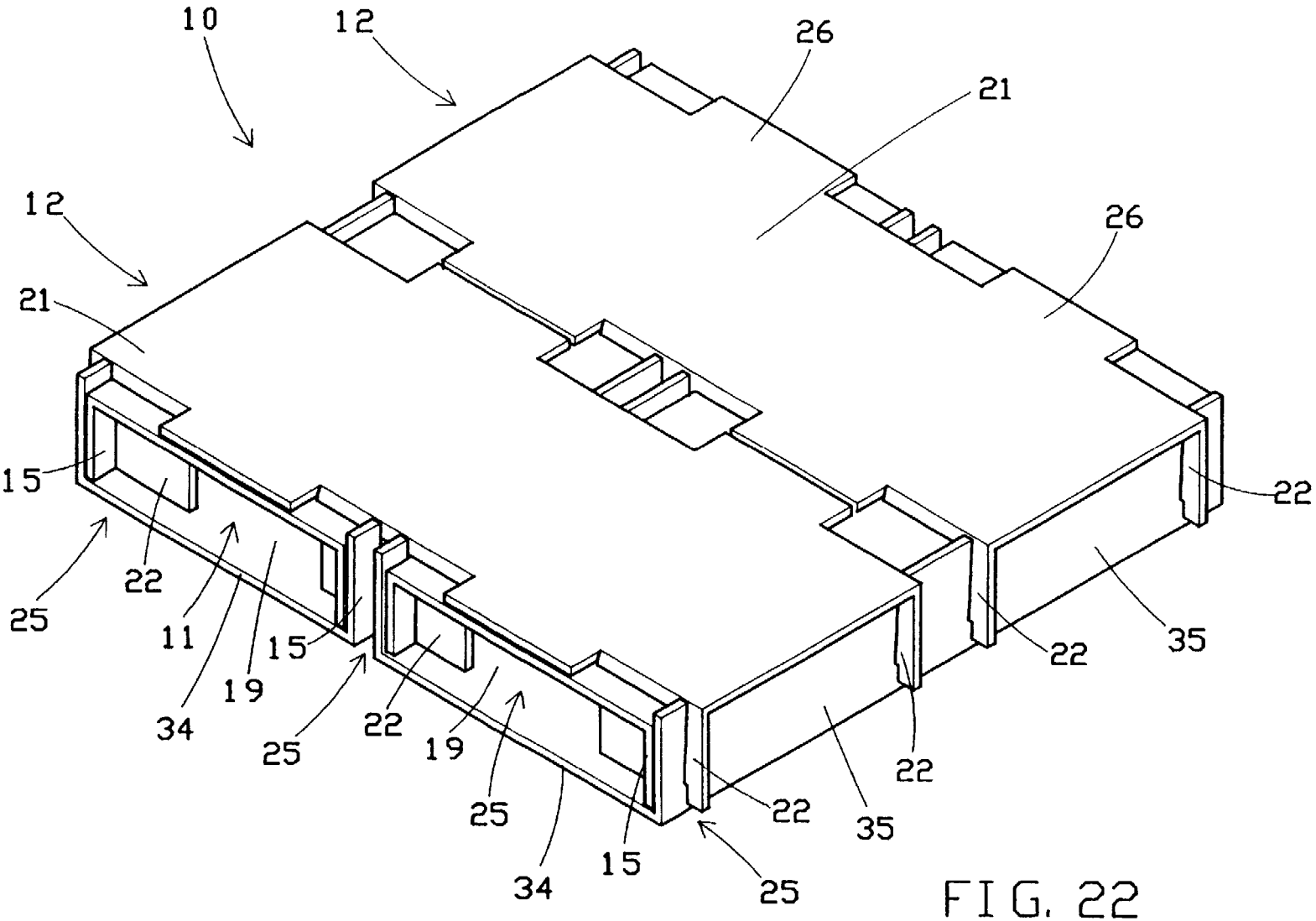
FIG. 22 is the perspective view of the eighth pallet embodiment.
Figure 23:
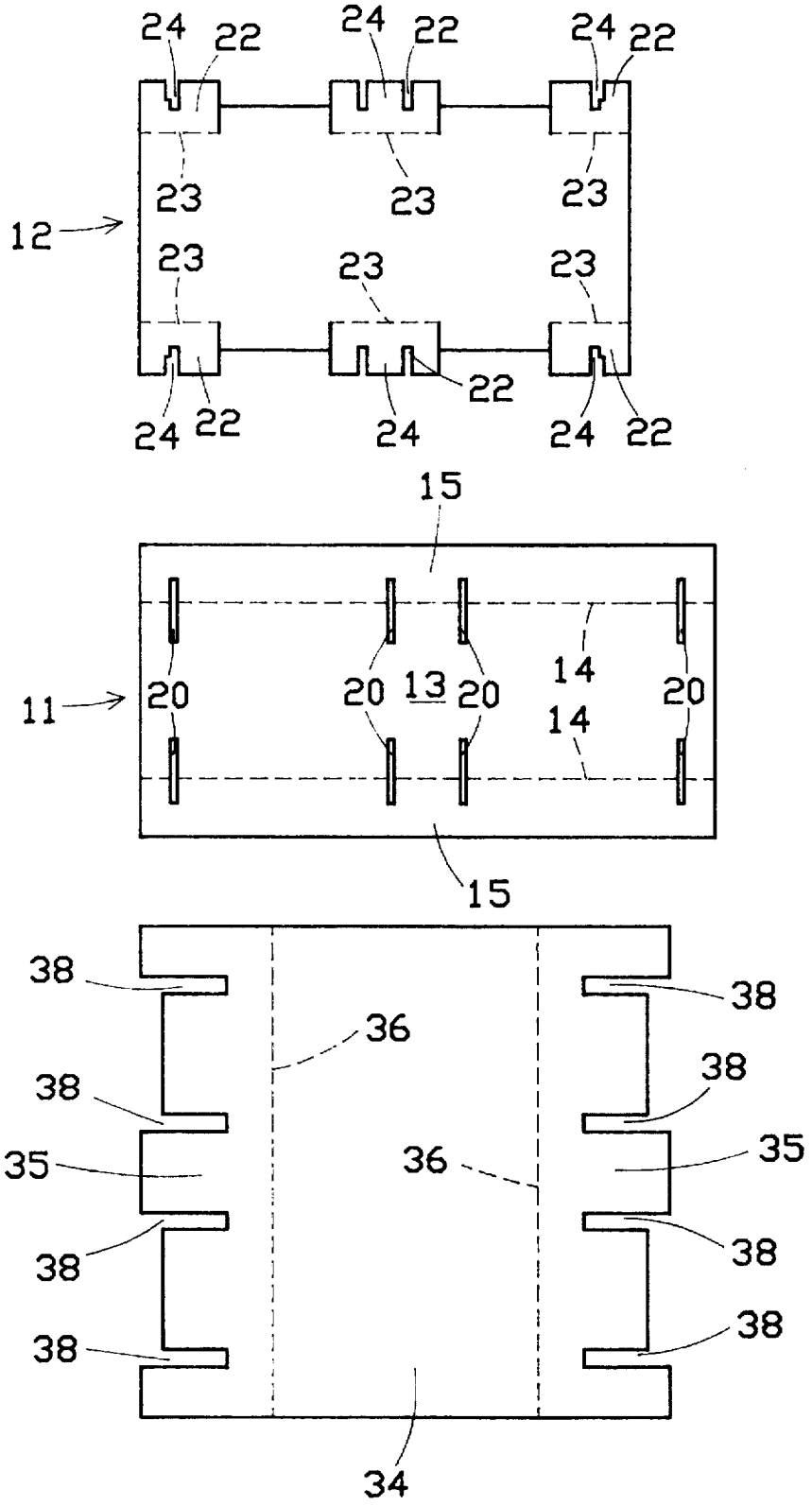
FIG. 23 is the spread view of the crosswise and lengthwise beams, and bottom plate of the eighth pallet embodiment.
Figure 24:
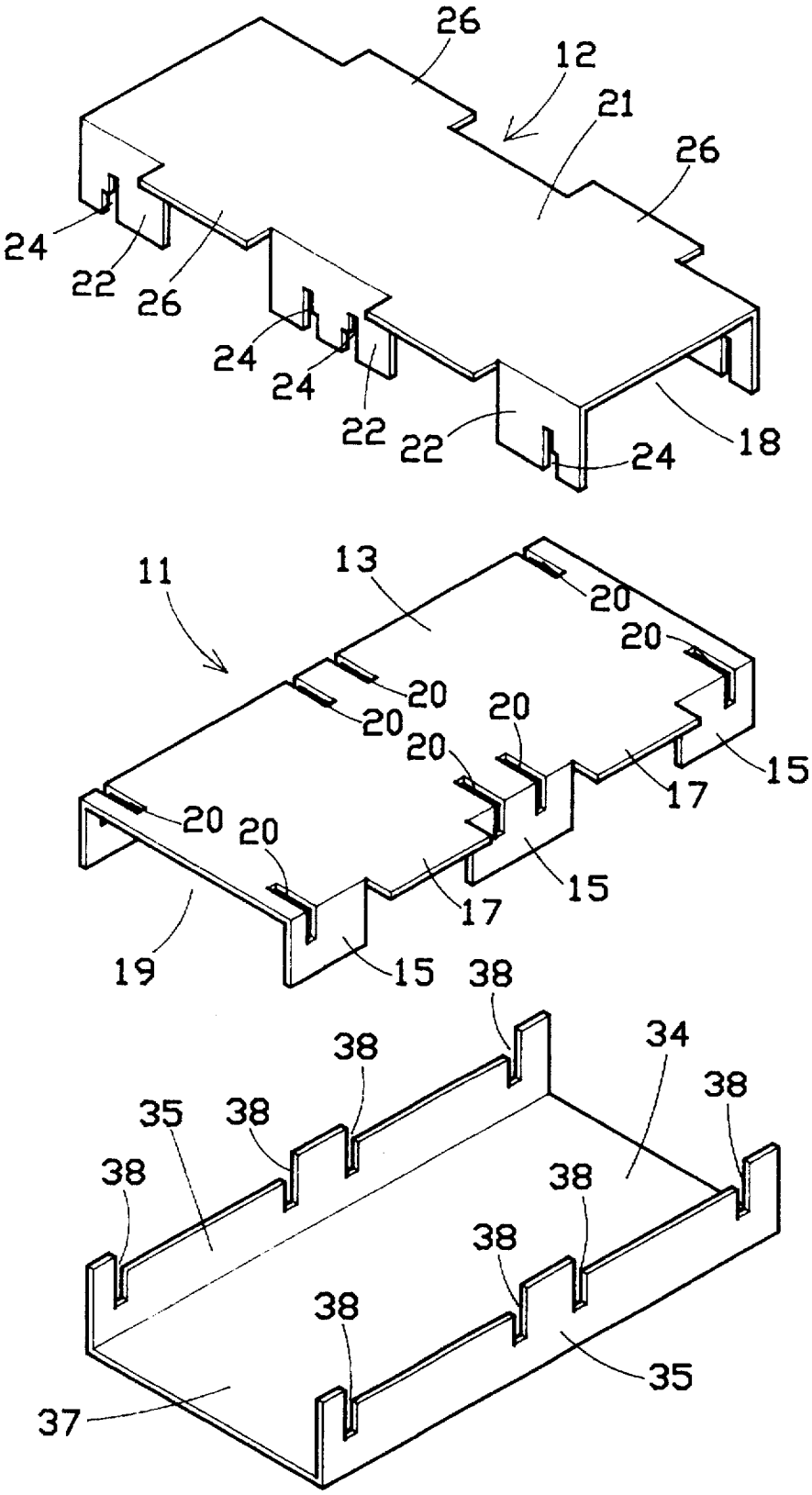
FIG. 24 is the perspective view of the crosswise and lengthwise beams, and bottom plate of the eighth pallet embodiment.

As in FIGS. 22, 23 and 24, the eighth embodiment of the subject invention, on the bottom of pallet 10 can have several bottom plates 34, this embodiment is illustrating two bottom plates 34 which is half the area of the seventh embodiment, the two bottom plates are formed by inserting the opening 38 of the bracket plate 35 to the corresponding opening 24 of the bracket plate 22 of crosswise beam 12, so that the two bottom plates 34 are joined to the bottom of pallet 10.

The subject invention is made of corrugated paper, which will reduce the production costs of pallets, the resources can be recycled, and waste disposal expenses can be reduced, so there will be no waste of resources and no subsequent environmental problems. Also the pallet made of light-weight corrugated paper will minimize the transportation expense and will reduce the burden on operators, so that they can have better operational safety. Meanwhile, when the pallets are not yet formed, they are flat, they will not occupy much space are, so it will effectively save much costs of production, storage and transportation.

Summing up, the subject invention has such excellent features as to solve such problems resulting from conventional pallets as inability to satisfy modern environmental protection, higher storage costs, higher transportation costs, occupation of large space areas, etc., so the subject invention, with its innovation and modem features, has fully satisfied the requirements for the application of a patent right. In accordance with the Patent Law, this application is filed for your examination. We would request your approval of the patent to protect the rights and interests of the inventor.

The aforesaid involves the preferred embodiments of the subject invention, which shall not be the restricted or limited areas of the patent. In other words, the scope of the subject invention shall include all similarly effective structural modifications based on the descriptions and figures of the subject invention.

I claim:

1. A collapsible pallet assembly comprising:

(a) at least a pair of lengthwise beam members formed of a corrugated paper material, each said lengthwise beam member including:

(1) a surface plate portion defining a plurality of first fold lines, said surface plate portion having formed therethrough a plurality of upper slot holes;

(2) a plurality of sidewall portions extending downward from said first fold lines to substantially define a first groove space beneath said surface plate portion, each said sidewall portion having at least one lower slot hole formed therethrough, each said lower slot hole being in open communication with at least one of said surface plate portion upper slot holes; and, (3) at least one wing piece portion projecting from said surface plate portion in a substantially coplanar manner; and, (b) at least a pair of crosswise beam members formed of a corrugated paper material coupled in transverse manner to said lengthwise beam members, each said crosswise beam member including:

(1) a top plate portion defining a plurality of second fold lines, said top plate portion at least partially overlaying at least one of said surface plate portions of said lengthwise beam members; and, (2) a plurality of bracket plate portions extending downward from said second fold lines to substantially define a second groove space beneath said top plate portion, each said bracket plate portion having formed therein a slotted opening delineating first and second bracket plate extending sections, each of said first and second bracket plate extending sections being adapted for insert through one of said surface plate portion upper slot holes, whereby said bracket plate portion matingly engages at least one of said sidewall portions of said lengthwise beam member.

* * * * *